US007153003B2

(12) United States Patent
Nakamura

(10) Patent No.: US 7,153,003 B2
(45) Date of Patent: Dec. 26, 2006

(54) ILLUMINATION APPARATUS FOR SINGLE-BASE LAMPS

(75) Inventor: Kenji Nakamura, Tokyo (JP)

(73) Assignee: Shodensha Corporation, Ltd., Tokyo (JP)

( * ) Notice: Subject to any disclaimer, the term of this patent is extended or adjusted under 35 U.S.C. 154(b) by 50 days.

(21) Appl. No.: 10/909,923

(22) Filed: Jul. 30, 2004

(65) Prior Publication Data

US 2005/0057927 A1 Mar. 17, 2005

(30) Foreign Application Priority Data

Jul. 31, 2003 (JP) ..... 2003-205152

(51) Int. Cl.
*F21V 11/00* (2006.01)
*F21V 1/00* (2006.01)
*F21V 21/28* (2006.01)

(52) U.S. Cl. ..... 362/353; 362/238; 362/240; 362/275

(58) Field of Classification Search ..... 362/226, 362/238, 275, 353, 640, 366, 148, 647, 649–651, 362/404, 405, 235, 247, 233
See application file for complete search history.

(56) References Cited

U.S. PATENT DOCUMENTS 991,289 A * 5/1911 Figge ..... 439/643
5,528,473 A * 6/1996 Kassay et al. ..... 362/247
5,772,315 A * 6/1998 Shen ..... 362/396
RE36,414 E * 11/1999 Tickner ..... 362/235
2002/0163812 A1* 11/2002 Tseng ..... 362/404

FOREIGN PATENT DOCUMENTS

JP P2000-164027 A 6/2000

OTHER PUBLICATIONS

Patent Abstracts of Japan, Publication No.: 2000-164027, Date of Publication: Jun. 16, 2000, 1 page.

* cited by examiner

*Primary Examiner*—Renee Luebke
*Assistant Examiner*—Evan Dzierzynski
(74) *Attorney, Agent, or Firm*—Osha Liang L.L.P.

(57) ABSTRACT

An illumination apparatus for single-base lamps is equipped with a power receiving plug which receives a supply of power by being fitted into a base socket of a power supply side, a main body which forms an integrated body with said power receiving plug, and a plurality of base sockets arranged on said main body on the opposite surface with said power receiving plug, wherein said base sockets are mounted at slopping angles which spread outward with respect to the axis of said power receiving plug.

5 Claims, 5 Drawing Sheets

ILLUMINATION APPARATUS FOR SINGLE-BASE LAMPS

BACKGROUND OF INVENTION

1. Field of the Invention

The present invention is related to an illumination apparatus for single-base lamps in which single-base type light-emitting means, such as fluorescent lamps or the like having a base plug at one end thereof, are mounted to carry out illumination, and in particular to an improvement of the mountability of arranging a plurality of light-emitting means, an improvement of the diffusivity of the light-emission beam emitted by the mounted light-emitting means, and an improvement of the productivity.

2. Background Art

As is well known, HID lamps (High Intensity Discharge lamps) are frequently used for illuminating sport facilities and business establishments (stores) and the like which have a relatively large-scale space. These HID lamps are preferred because the light beam of each lamp has large characteristics due to the fact that a light-emission operation based on mercury atoms is an operation carried out in the visible light range.

However, because these HID lamps have the property of emitting light at high temperatures, it takes time for the brightness to stabilize after current is passed therethrough. Further, in order to turn these lamps on again after they have been turned off temporarily, the lamps need to be returned to such temperature and can not be turned on immediately, and because of such characteristic defects, these lamps need to be replaced with other light-emitting means.

In this regard, the present applicants proposed the illumination apparatus shown in Patent Document 1(Japanese Laid-Open Patent Publication Number 2000-164027), for example. This illumination apparatus uses fluorescent lamps which are so-called fluorescent lights as light-emitting means. Further, in this illumination apparatus, a fitting base plug is provided in a base socket for a mercury lamp, a plurality of base sockets are arranged on an opposite surface, and fluorescent lamps are mounted in these base sockets to carry out illumination. The fluorescent lamps are single-base type lamps having screw type base plugs at one end thereof which achieve an improvement from the aspect of energy savings because the power consumption due to light emission caused by fluorescent action is remarkably low.

In a single-base type fluorescent lamp, the base plug frequently uses a general E26 base in order to make the fluorescent lamp interchangeable with a bulb lamp. Further, various lamps having different shapes and sizes such as length, thickness and the like due to requirements such as light-emission performance and decorativeness and the like are manufactured.

For this reason, at the illumination apparatus side, there needs to be a correspondence with such various fluorescent lamps having different sizes and shapes. Incidentally, in the publication mentioned above, because a plurality of base sockets are arranged close together, in the case where round fluorescent lamps having large diameters are used, for example, the mounting regions of adjacent base sockets will overlap, and this interference will make it impossible to mount such lamps.

SUMMARY OF INVENTION

In view of the background described above, it is an object of the present invention to solve the problems described above and provide an illumination apparatus for single-base lamps having wide applicability in which various single-base lamps having different sizes and shapes can be mounted to obtain good light emission without interfering with each other.

In order to achieve the object stated above, the illumination apparatus for single-base lamps according to the present invention is an illumination apparatus for single-base lamps in which single-base type light-emitting means, such as fluorescent lamps or the like having a base plug at one end thereof, are mounted to carry out illumination, and is equipped with a power receiving plug which receives a supply of power by being fitted into a base socket of a power supply side arranged at a facility place such as a ceiling or the like, and a main body which forms an integrated body with the power receiving plug. Further, a plurality of base sockets are arranged on the main body on the opposite surface with the power receiving plug, and these base sockets are mounted at slopping angles which spread outward with respect to the axis of the power receiving plug.

Further, an extension portion may be provided between the power receiving plug and the main body to extend the space therebetween. Further, the illumination apparatus may also be equipped with a hole formed in the center of the power receiving plug, a nut portion provided at a corresponding position of the main body, and a connecting bolt which is inserted from the hole and screwed into the nut portion, wherein the connecting bolt and the nut portion are formed from an electrically conductive material, whereby electrical wiring is formed between the nut portion and one electrode of the base sockets.

In the present invention, because the base sockets are mounted at slopping angles which spread outward with respect to the axis of the power receiving plug, it is possible to secure mutually wide mounting regions between adjacent base sockets. For this reason, single-base lamps can be mounted in each base socket without mutual interference even when the single-base lamps are round lamps having large diameters, for example.

Further, because an extension portion is provided between the power receiving plug and the main body to extend the space therebetween, by carrying out length adjustment, the illumination apparatus can be mounted at an appropriate length for an existing lamp shade (reflector) at a mounting place. Further, because the assembling of the illumination apparatus is completed by fastening the connecting bolt from the power receiving plug side, the connecting bolt forms one side of the electrode wiring.

DETAILED DESCRIPTION

Figure 1:
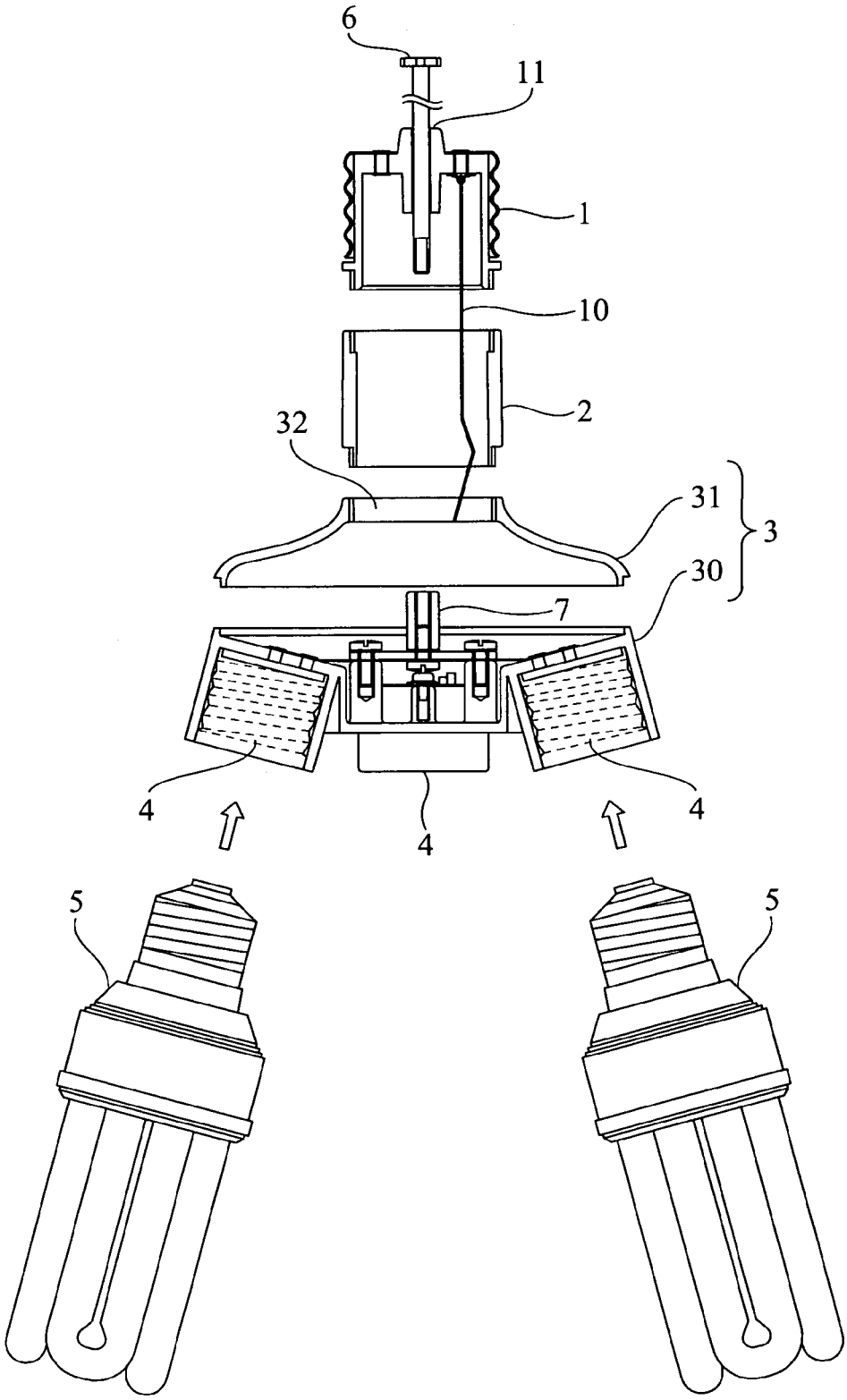
FIG. 1 is a side view of an illumination apparatus for single-base lamps according to a first embodiment of the present invention.

FIG. 1 shows a first embodiment of the present invention. In this embodiment, an illumination apparatus for single-base lamps is equipped with a power receiving plug 1, an extension tube 2, a main body 3 and a plurality of base sockets 4 and the like. Further, the illumination apparatus is constructed to carry out illumination by single-base type light-emitting means such as fluorescent lamps 5 or the like which are mounted in the base sockets 4. Further, each portion in FIG. 1 is shown in a separated state.

The power receiving plug 1 is formed as a screw type base plug which receives a supply of power by being fitted into a base socket of a power supply side arranged at a facility place such as the ceiling or the like. The power receiving plug 1 is formed as a base plug like the so-called E39, for example. The E39 base is frequently used in HID lamps and the like. Accordingly, by forming the power receiving plug 1 as an E39 base, the illumination apparatus can be installed without alteration as a replacement for a HID lamp.

The main body 3 is formed by two pieces, namely, a base portion 30 and a connecting portion 31 which fit together. Further, the extension tube 2 or the power receiving plug 1 fits into a hole 32 formed in the center of the connecting portion 31, and an integrated body is formed with the power receiving plug 1 side by fastening with a connecting bolt 6 described later.

Further, a plurality of base sockets 4 are arranged on the base portion 30 on the opposite surface with the power receiving plug 1. Further, these base sockets 4 are mounted at slopping angles which spread outward with respect to the axis of the power receiving plug 1.

The base sockets 4 are formed as screw type base sockets like the so-called E26, for example. This is for mounting fluorescent lamps as light-emitting means, and because E26 base fluorescent lamps are used widely. Namely, the fluorescent lamps 5 are so-called fluorescent lights in which a fluorescent material applied to the inside wall of a glass tube is made to emit light, and have a screw type base plug on one end thereof to form a single-base lamp which can replace a bulb lamp.

The extension tube 2 is a tubular body having an appropriate length. Namely, the extension tube 2 is an extension portion which extends the space between the power receiving plug 1 and the main body 3, and by preparing a plurality of these having different lengths, the extension tube 2 can be replaced with an appropriate selection.

Figure 2:
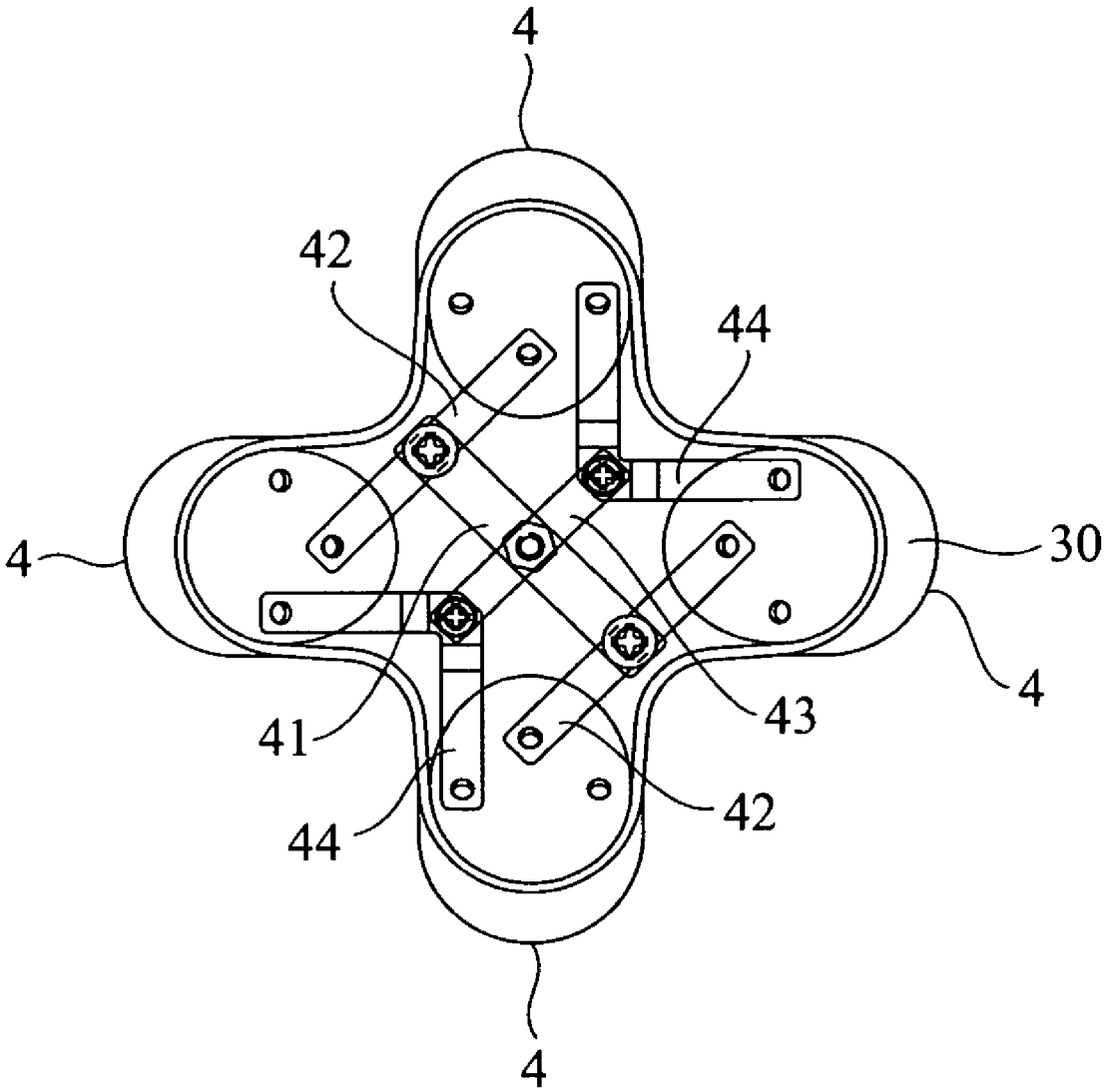
FIG. 2 is a plan view showing electrical wiring inside a main body.

Further, a hole 11 is formed in the center of the power receiving plug 1, and a nut portion 7 is provided at a corresponding position of the base portion 30. Further, the connecting bolt 6 is inserted from the hole 11, and a thread portion on the tip of the connecting bolt 6 is screwed into the nut portion 7. The connecting bolt 6 and the nut portion 7 are formed from a conductive material. Further, the nut portion 7 is connected to conductive plates 41, 42 as shown in FIG. 2 to form an electrical connection with the center electrodes of the base sockets 4. The surrounding electrodes of the base sockets 4 are connected to conductive plates 43, 44, and a wire 10 extending from the surrounding electrode of the power receiving plug 1 is connected to the conductive plates 43, 44.

Figure 3:
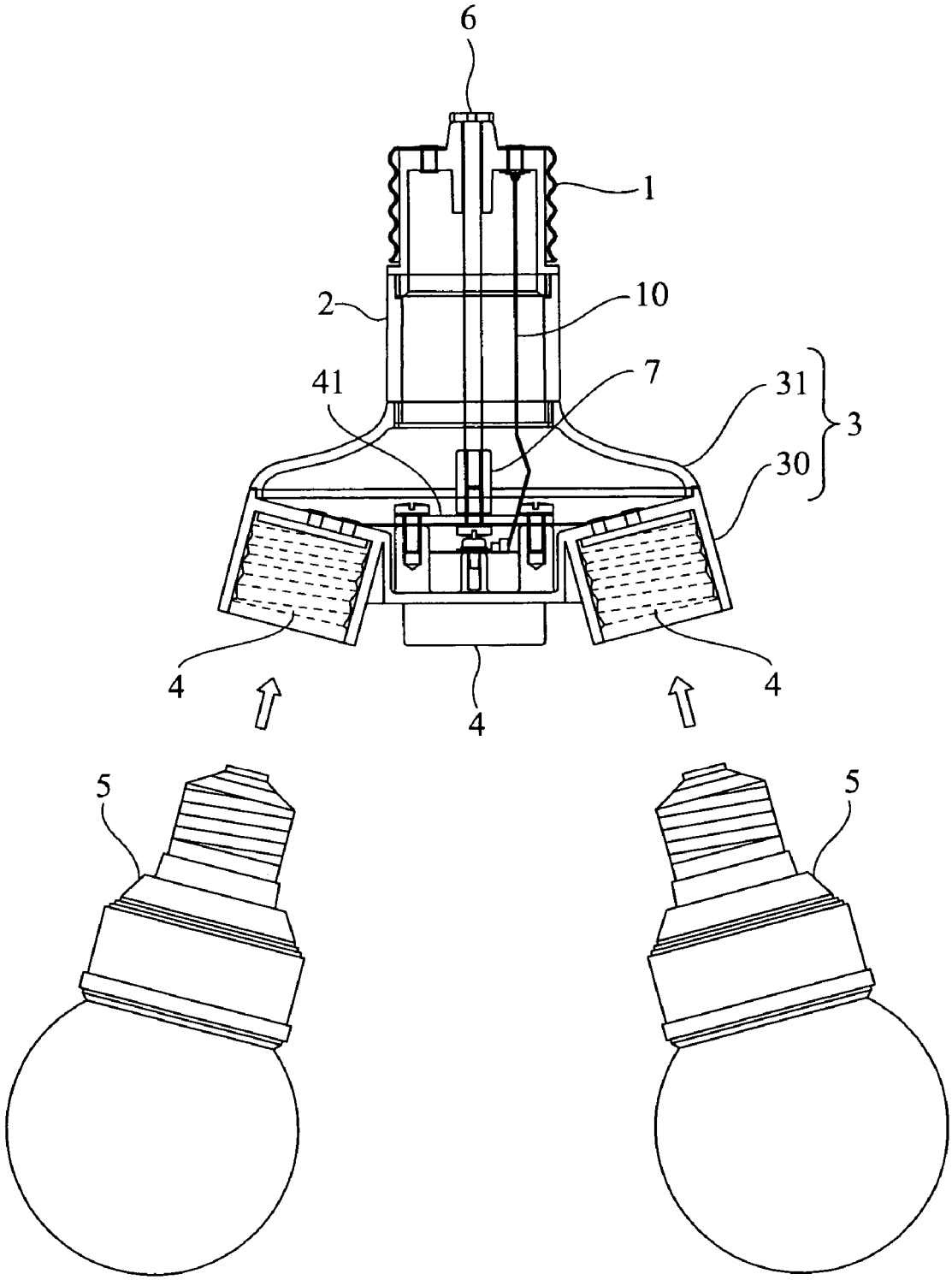
FIG. 3 is a side view showing an example of mounted fluorescent lamps.

In this way, because the base sockets 4 are mounted at slopping angles which spread outward with respect to the axis of the power receiving plug 1, it is possible to secure mutually wide mounting regions between adjacent base sockets 4. Accordingly, the fluorescent lamps 5 can be mounted without interference even when the fluorescent lamps 5 are round lamps having large diameters like those shown in FIG. 3. As a result, it is possible to mount various single-base lamps having different sizes and shapes without interference, and the corresponding range of uses as an illumination apparatus has wide applicability.

Further, because the plurality of fluorescent lamps 5 are mounted in slopping positions which spread outward, it is possible to shine light to the upper side, namely, the power receiving plug 1 side, and the emitted light can be diffused over a wide area, whereby a wide area illumination can be carried out. Further, because the fluorescent lamps 5 are mounted in outward slopping positions, it is possible to give the impression that the emitted light illuminates a wide area even when looked at, and this makes it possible to produce a wide illumination.

Incidentally, some illumination facilities are equipped with lamp shades, but the illumination apparatus according to the present invention can be preferably applied even to such facilities. Namely, FIGS. 4(*a*)~4(*c*) are side views showing examples of modifications for lamp shades. As shown in these drawings, modifications in which the extension tube 2 is replaced appropriately are carried out.

Figure 4:
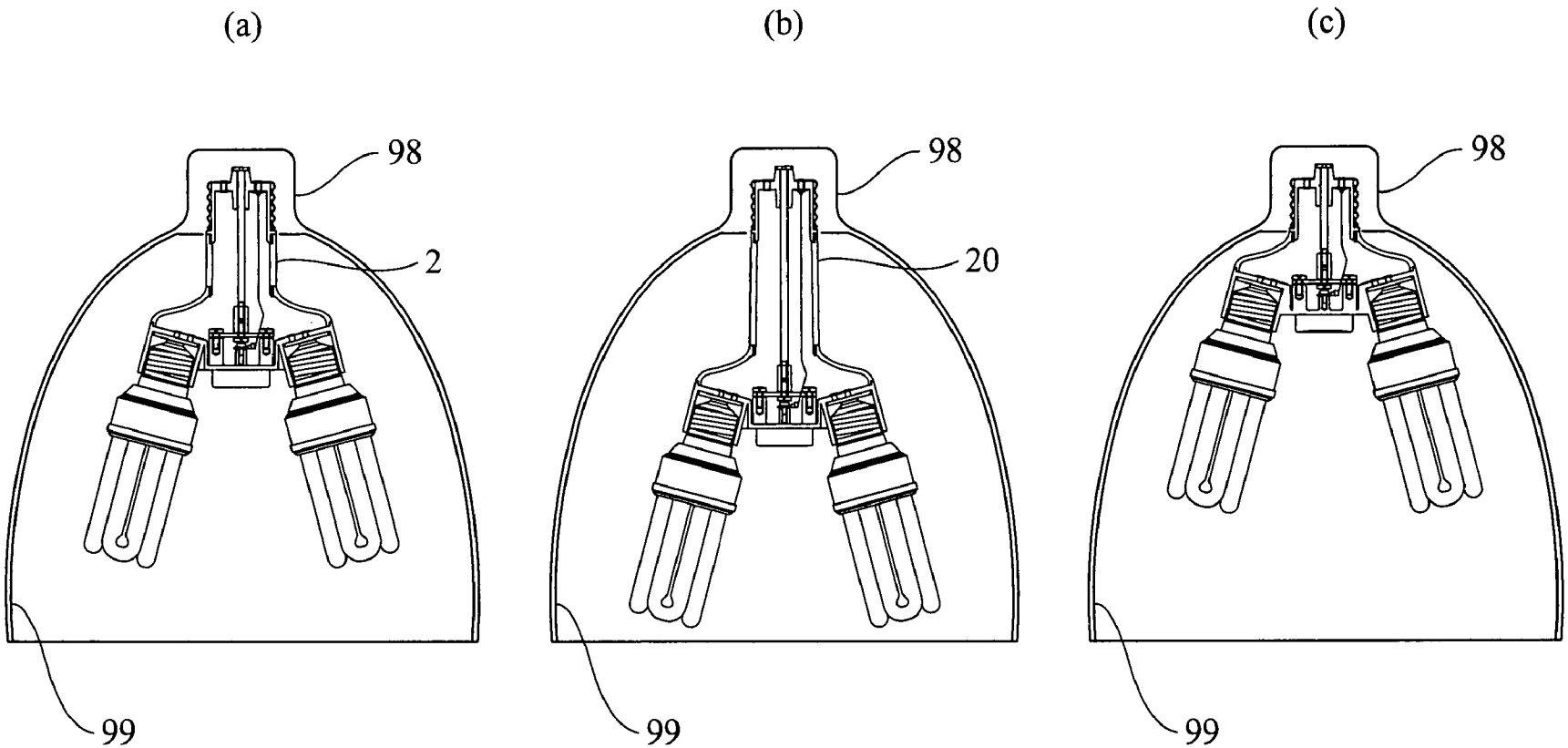
FIGS. 4(*a*)~4(*c*) are side views showing examples of modifications for a lamp shade.

Namely, the illumination apparatus according to the present invention can be set in a base socket 98 of a lamp shade 99 in the manner shown in FIG. 4(*a*), wherein the illumination apparatus is assembled using the extension tube 2 having a prescribed length. Further, the illumination apparatus according to the present invention may be set in the base socket 98 of the lamp shade 99 in the manner shown in FIG. 4(*b*), wherein the illumination apparatus is assembled using an extension tube 20 having an extended length. Further, the illumination apparatus according to the present invention can be set in the base socket 98 of the lamp shade 99 in the manner shown in FIG. 4(*c*), wherein the power receiving plug 1 is fitted together directly with the connecting portion 31 so that the illumination apparatus is assembled without using the extension tube 2.

In this way, because an extension portion (extension tube 2) is provided between the power receiving plug 1 and the connecting portion 31 to extend the space therebetween, by preparing a plurality of extension tubes 2 having different lengths, it is possible to carry out length adjustment by selective replacement. Accordingly, the illumination apparatus can be mounted at an appropriate length for the existing lamp shade 99. Further, because the positions of the fluorescent lamps 5 are changed, the reflection due to the lamp shade 99 can be changed appropriately so that the reflected light is converged in a prescribed way or is diffused widely or the like, and this makes it possible to obtain an optimized reflection.

Further, even in the example case where the power supply side base socket is arranged deep inside the ceiling from the ceiling surface in an existing facility, the illumination apparatus of the present invention can be mounted therein by adjusting the length of the extension portion to correspond to such arrangement.

Furthermore, even though it is necessary to prepare various mounting lengths for the illumination apparatus, because this is achieved in the present embodiment by preparing a plurality of extension tubes 2 having different lengths which serve as extension portions, the present invention is advantageous in view of cost.

Further, because the assembling of the illumination apparatus is completed by fastening the connecting bolt 6 from the power receiving plug 1 side so that the connecting bolt 6 forms one side of the electrode wiring, the assembling and wiring processes can be carried out easily.

At this point it should be noted that the present invention is of course not limited to the structure of the first embodiment described above, and it is possible to form a structure in which the connecting portions of the power receiving plug 1, the extension tube 2, the connecting portion 31 and the base portion 30 are provided with thread portions that are screwed together to assemble the illumination apparatus. Further, it is possible to form a structure in which the connecting portions are provided with a mechanism that fits together with one touch, and electric contact points are provided at corresponding positions so that the electrical wiring is connected at the same time the connecting portions are fitted together with one touch to assemble the illumination apparatus.

As described above, in the illumination apparatus for single-base lamps according to the present invention, because the base sockets are mounted at slopping angles which spread outward with respect to the axis of the power receiving plug, it is possible to secure mutually wide mounting regions between adjacent base sockets. For this reason, single-base lamps can be mounted without interference even when the single-base lamps are round lamps having large diameters, for example. As a result, it is possible to mount various single-base lamps having different sizes and shapes without interference, and the corresponding range of uses as an illumination apparatus has wide applicability.

Further, because the plurality of single-base lamps are mounted in slopping positions which spread outward, it is possible to shine light to the upper side, namely, the power receiving plug side, and the emitted light can be diffused over a wide area, whereby a wide area illumination can be carried out. Further, because the single-base lamps are mounted in outward slopping positions, it is possible to give the impression that the emitted light illuminates a wide area even when looked at, and this makes it possible to produce a wide illumination.

Further, because an extension portion is provided between the power receiving plug and the main body to extend the space therebetween, by carrying out length adjustment, the illumination apparatus can be mounted at an appropriate length for an existing lamp shade at a mounting place. At this time, because the positions of the single-base lamps are changed, the reflection due to the lamp shade can be changed appropriately so that the reflected light is converged in a prescribed way or is diffused widely or the like, and this makes it possible to obtain an optimized reflection.

Further, because the assembling of the illumination apparatus is completed by fastening the connecting bolt from the power receiving plug side so that the connecting bolt forms one side of the electrode wiring, the assembling can be carried out easily.

A illumination apparatus for single-base lamps of detailed description of the preferred embodiment comprises a power receiving plug 1. Thus, an illumination apparatus for single-base lamps can be easily loaded in the place where a clasp socket of the power supply side such as a HID lamp such as a ceiling is posted.

Figure 5:
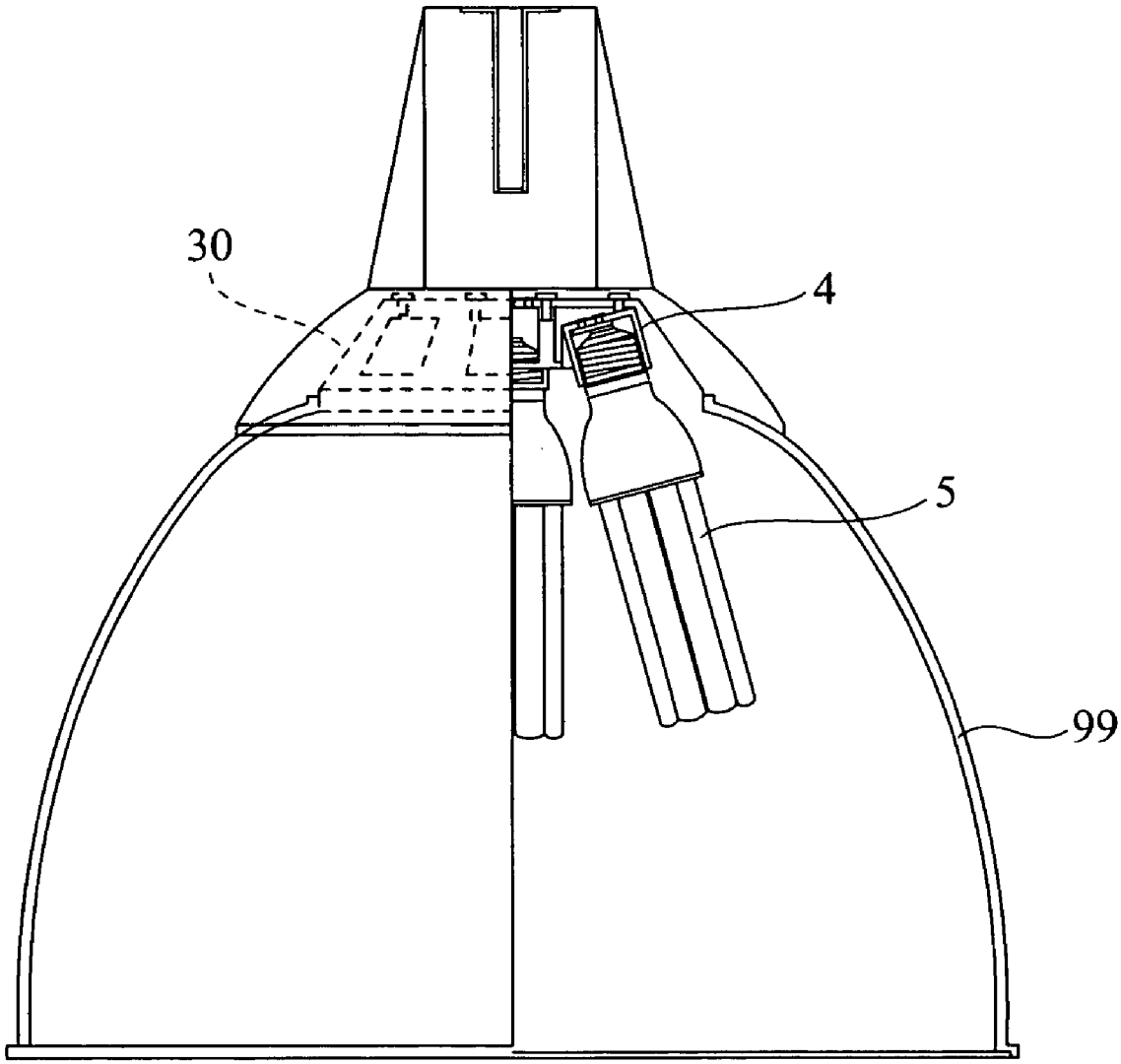
FIG. 5 is a side view of an illumination apparatus for single-base lamps according to a second embodiment of the present invention.

However, this needs not to be limited to, and the present invention can be installed for the thing which a base socket of the power supply side is not arranged. In other words, with the present invention, the main body comprising base portion 30 comprising base socket 4 slanted outward is the smallest componentry. By way of example only, as shown in FIG. 5, this base portion 30 is installed to lamp shade 99. And, for this base portion 30, plural fluorescence lamps 5 is installed, and lamp shade 99 is hung on ceilings. Power supply cord it is illustrated, and to omit is connected to base portion 30. And electricity is supplied to each base socket 4 through the power supply cord.

What is claimed is:

1. An illumination apparatus for single-base lamps, comprising:

a power receiving plug adapted to receive power when fitted into a primary base socket of a power supply, the power receiving plug having an aperture formed along a central axis thereof;

a main body that forms an integrated body with said power receiving plug;

a plurality of secondary base sockets arranged on said main body on a side opposite said power receiving plug;

an elongated connecting member disposed within the aperture and extending through the main body toward said opposite side; and a securing member attached to a distal end portion of the connecting member so as to secure the connecting member to the main body;

wherein said connecting member and said securing member are formed from an electrically conductive material, and wherein an electrical connection is formed between the securing member and each of the secondary base sockets; and wherein said secondary base sockets are mounted at sloping angles that spread outward with respect to the central axis of said power receiving plug.

2. The illumination apparatus for single-base lamps described in claim 1, further comprising an extension tube which extends a distance between said power receiving plug and said main body.

3. The illumination apparatus for single-base lamps described in claim 1, wherein the connecting member is a bolt.

4. The illumination apparatus for single-base lamps described in claim 1, wherein the securing member is a nut.

5. The illumination apparatus for single-base lamps described in claim 1, wherein the connecting member forms an electrical contact at a base portion of the power receiving plug.

* * * * *